US008033063B2

(12) United States Patent
Won

(10) Patent No.: US 8,033,063 B2
(45) Date of Patent: Oct. 11, 2011

(54) STAIR SYSTEM

(76) Inventor: Yong Hwan Won, Waldorf, MD (US)

( * ) Notice: Subject to any disclaimer, the term of this patent is extended or adjusted under 35 U.S.C. 154(b) by 0 days.

(21) Appl. No.: 12/474,064

(22) Filed: May 28, 2009

(65) Prior Publication Data

US 2009/0235594 A1 Sep. 24, 2009

Related U.S. Application Data

(63) Continuation-in-part of application No. 12/007,211, filed on Jan. 8, 2008, now abandoned, which is a continuation-in-part of application No. 11/714,774, filed on Mar. 7, 2007, now abandoned.

(51) Int. Cl.
*E04F 11/00* (2006.01)

(52) U.S. Cl. ..... 52/188; 52/191; 52/183; 52/179

(58) Field of Classification Search ..... 52/188, 52/190, 191, 183, 182, 179, 177, 741.2, 184, 52/185, 186; D25/69; D30/199
See application file for complete search history.

(56) References Cited

U.S. PATENT DOCUMENTS

| | | | | | |
|---|---|---|---|---|---|
| 184,013 | A | * | 11/1876 | Krick | 52/179 |
| 256,336 | A | * | 4/1882 | Lawrence | 52/177 |
| 606,532 | A | * | 6/1898 | Furness | 52/179 |
| 973,346 | A | * | 10/1910 | Davis | 52/179 |
| 1,475,777 | A | * | 11/1923 | Ballenger | 52/189 |
| 1,674,713 | A | * | 6/1928 | Brooks | 52/179 |
| 1,919,629 | A | * | 7/1933 | Galtieri | 52/179 |
| 2,021,457 | A | * | 11/1935 | MacKenzie | 52/191 |
| 2,696,027 | A | * | 12/1954 | Ryland | 52/182 |
| 2,760,239 | A | * | 8/1956 | Riley | 52/183 |
| 2,881,485 | A | * | 4/1959 | Hyman | 52/179 |
| 3,287,867 | A | * | 11/1966 | Aton | 52/179 |
| 3,393,481 | A | * | 7/1968 | Meuret | 52/188 |
| 4,367,613 | A | * | 1/1983 | Strub | 52/188 |
| 6,115,975 | A | | 9/2000 | Abdollahi | |
| 6,397,529 | B1 | * | 6/2002 | Grenier | 52/182 |
| 6,516,574 | B1 | * | 2/2003 | Couture | 52/182 |
| 2002/0170257 | A1 | | 11/2002 | McLain et al. | |
| 2005/0079323 | A1 | | 4/2005 | Miller et al. | |
| 2005/0229517 | A1 | | 10/2005 | Gomez Insa | |
| 2006/0024465 | A1 | | 2/2006 | Briere | |
| 2006/0185287 | A1 | | 8/2006 | Glazer et al. | |

FOREIGN PATENT DOCUMENTS

EP 224918 A2 * 6/1987

* cited by examiner

*Primary Examiner* — Robert Canfield
*Assistant Examiner* — Babajide Demuren
(74) *Attorney, Agent, or Firm* — Birch, Stewart, Kolasch & Birch, LLP

(57) ABSTRACT

A stair system including an upper tread having a substantially planar body portion, a stair nose portion located at one side of the planar body portion, and a dado located behind the stair nose portion, at least one lower tread, the lower tread having a substantially planar body portion, a stair nose portion located at one side of the planar body portion, a dado located behind the stair nose portion, and a groove located at a side opposite the stair nose portion, and at least two risers, each riser having a substantially planar body portion. In the stair system, one of the at least two risers is receivable between the dado of the upper tread and the groove of the lower tread and the other of the at least two risers is receivable in the dado of the lower tread.

22 Claims, 7 Drawing Sheets

STAIR SYSTEM

CROSS-REFERENCE TO RELATED APPLICATIONS

This application is continuation-in-part of prior application Ser. No. 12/007,211, filed Jan. 8, 2008, now abandoned, and is a continuation-in-part application of prior application Ser. No. 11/714,774, filed Mar. 7, 2007, now abandoned, all of which are herein incorporated by reference in their entireties.

BACKGROUND OF THE INVENTION

1. Field of the Invention

The present invention is generally directed to a stair system, and more particularly to modular treads and risers of a stair system.

2. Description of Related Art

Generally, stair systems having nose moldings have been constructed in a similar manner using the same basic methods. For example, most stair systems employ a plurality of stringers having tread sides cut out, on which are secured tread sub flooring that span between the stringers. The stringers also have riser sides cut out, on which are secured riser sub floorings that also span between the stringers. Depending on the finishing materials for the stair system, a tread and riser may be mounted to the tread sub flooring or carpeting, with or without padding, may be affixed to the tread sub flooring and riser sub flooring. Where carpeting is used, the tread sub flooring may provide an overhang to allow the carpet to be affixed to the underside of the overhang, thereby hiding the means of fastening the carpet to the tread sub flooring. Sub flooring is normally secured using nails, screws, and/or adhesives Because most stair systems are normally built from the top down, in the case of steps having a wood finish, the top most tread is attached using adhesive and a stair nose is attached to the end of the tread to overlap a portion of the tread and to cover the remainder of the tread sub flooring. Generally the stair nose extends beyond the tread sub flooring a sufficient distance to allow a riser to be disposed beneath the stair nose.

The first step below the top step is assembled by placing a riser underneath the stair nose and affixing it to the riser sub flooring using either fasteners or adhesive. The next tread must be cut to have a square edge, as it must abut the riser. Then the stair nose is attached to the end of the tread to overlap a portion of the tread and to cover the remainder of the tread sub flooring as discussed above. This process is repeated for each successive step.

In an alternative stair system, the stair nose may be affixed to the tread by using a tongue and groove relationship. The tread and risers are affixed to the tread sub flooring and riser sub flooring using fasteners or adhesive as described above. In all of the above cases, it is important that expansion of the wood be accounted for in the assembly of the stairs. As such, sufficient gaps must be provided between pieces of wood to allow the individual pieces to expand.

The first system permits the tread and risers to be free-floating, allow them to contract and expand with changes in temperature and humidity. However, they are unattractive in that the stair nose is higher than the tread because of the overlapping arrangement. The second system does allow the tread and stair nose to be coplanar, but because they are joined by the tongue and groove, the system does not allow the tread and risers to be free-floating.

U.S. Pat. No. 6,115,975 proposes a solution to providing a nose stair that is coplanar with the tread, but still allows the tread and riser to be free floating. The stair system provides a stair nose connected by a tongue and groove arrangement to a tread. A back molding is affixed to the tread and includes a groove to receive a riser therein. A corresponding groove is formed in the stair nose such that the riser is held between the stair nose and the back molding. In this manner, the riser can be allowed to expand and contract with the temperature and humidity, thereby providing treads and risers that are free floating.

However, U.S. Pat. No. 6,115,975 is a complicated system that requires many additional components. As a result the assembly process is unnecessarily complicated.

BRIEF SUMMARY OF THE INVENTION

According to principles of this invention, a stair system is provided that minimizes the components of the stair system and provides an efficient assembly process by allowing flexibility in the placement of the riser(s). The stair system includes a tread, the tread having a substantially planar body portion, a stair nose portion located at one side of the planar body portion, a dado located behind the stair nose portion, and a first plurality of grooves located at a side opposite the stair nose portion, a first riser having a substantially planar body portion, the first riser being received in one of the plurality of grooves, and a second riser having a substantially planar body portion, the second riser being received in the dado of the tread.

In another aspect, the first plurality of grooves may be spaced closer towards the side opposite the stair nose portion. Alternatively, the first plurality of grooves may be substantially evenly spaced between the stair nose portion and the side opposite the stair nose portion.

In a different aspect, at least one of the first plurality of grooves may be selected from a rectangular cut-out, a substantially circular cut-out, and a triangular cut-out. Alternatively, each of the first plurality of grooves may be selected from a rectangular cut-out, a substantially circular cut-out, and a triangular cut-out. All of the first plurality of grooves may have substantially the same cut-out.

In yet another aspect, the stair system may include a molding located beneath the tread and adjacent the dado of the tread. The molding may be affixed to at least one of the tread and the second riser.

In still another aspect, the stair nose of the tread may include a second groove formed thererin. Alternatively, the stair nose of the tread may include a plurality of second grooves formed thererin.

In still a further aspect, at least one of the second plurality of grooves may be selected from a rectangular cut-out, a substantially circular cut-out, and a triangular cut-out. Alternatively, each of the second plurality of grooves may be selected from a rectangular cut-out, a substantially circular cut-out, and a triangular cut-out. All of the second plurality of grooves may have substantially the same cut-out.

In accordance with another aspect of the present invention, a stair system having an upper tread having a substantially planar body portion, a stair nose portion located at one side of the planar body portion, and a dado located behind the stair nose portion, at least one lower tread, the lower tread having a substantially planar body portion, a stair nose portion located at one side of the planar body portion, a dado located behind the stair nose portion, and a groove located at a side opposite the stair nose portion, and at least two risers, each riser having a substantially planar body portion, in provided.

In the stair system, one of the at least two risers is receivable between the dado of the upper tread and the groove of the lower tread and the other of the at least two risers is receivable in the dado of the lower tread.

In another aspect, the groove of the at least one lower tread may be formed in an upper surface of the planar body portion. The groove of the at least one lower tread may be a rabbet or a dado.

In a different aspect, the at least one lower tread includes a plurality of lower treads. Each of the lower tread may have a substantially planar body portion, a stair nose portion located at one side of the planar body portion, a dado located behind the stair nose portion, and a groove located at a side opposite the stair nose portion. In addition, the at least two risers may include a plurality of risers such that the number of risers corresponds to the number of lower treads plus the upper riser.

In yet another aspect, the stair nose portions of the upper tread may have a thickness substantially equal to the thickness of the planar body portion of the upper tread and the stair nose portion of the at least one lower tread may have a thickness substantially equal to the thickness of the planar body portion of the at least one lower tread. Alternatively, the stair nose portions of the upper tread may have a thickness greater than the thickness of the planar body portion of the upper tread and the stair nose portion of the at least one lower tread may have a thickness greater than the thickness of the planar body portion of the at least one lower tread.

In a further aspect, the stair system includes at least two stringers, each stringer having a plurality of tread sides and a plurality of riser sides, a plurality of tread sub-floorings corresponding to the plurality of tread sides, each of the plurality of tread sub-floorings spanning between the at least two stringers and affixed to corresponding tread sides, and a plurality of riser sub-floorings corresponding to the plurality of riser sides, each of the plurality of riser sub-floorings spanning between the at least two stringers and affixed to corresponding riser sides.

In still another aspect, the upper tread may be affixed to one of the plurality of tread sub-floorings, the at least one lower tread may be affixed to another of the plurality of tread sub-floorings, and each of the at least two risers may be affixed to different riser sub-floorings.

In yet another aspect, an end of each of the tread sub-flooring may extend beyond the lower adjacent riser sub-flooring such that the riser sub-flooring is recessed behind the end of the tread sub-flooring.

In a further aspect, the upper tread may be affixed to one of the plurality of tread sub-floorings and the at least one lower tread is affixed to another of the plurality of tread sub-floorings.

In still a further aspect, each of the plurality of risers may be affixed to the corresponding dado. Alternatively, each of the plurality of risers may be affixed to the end of the upper adjacent tread sub-flooring.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

Figure 1:
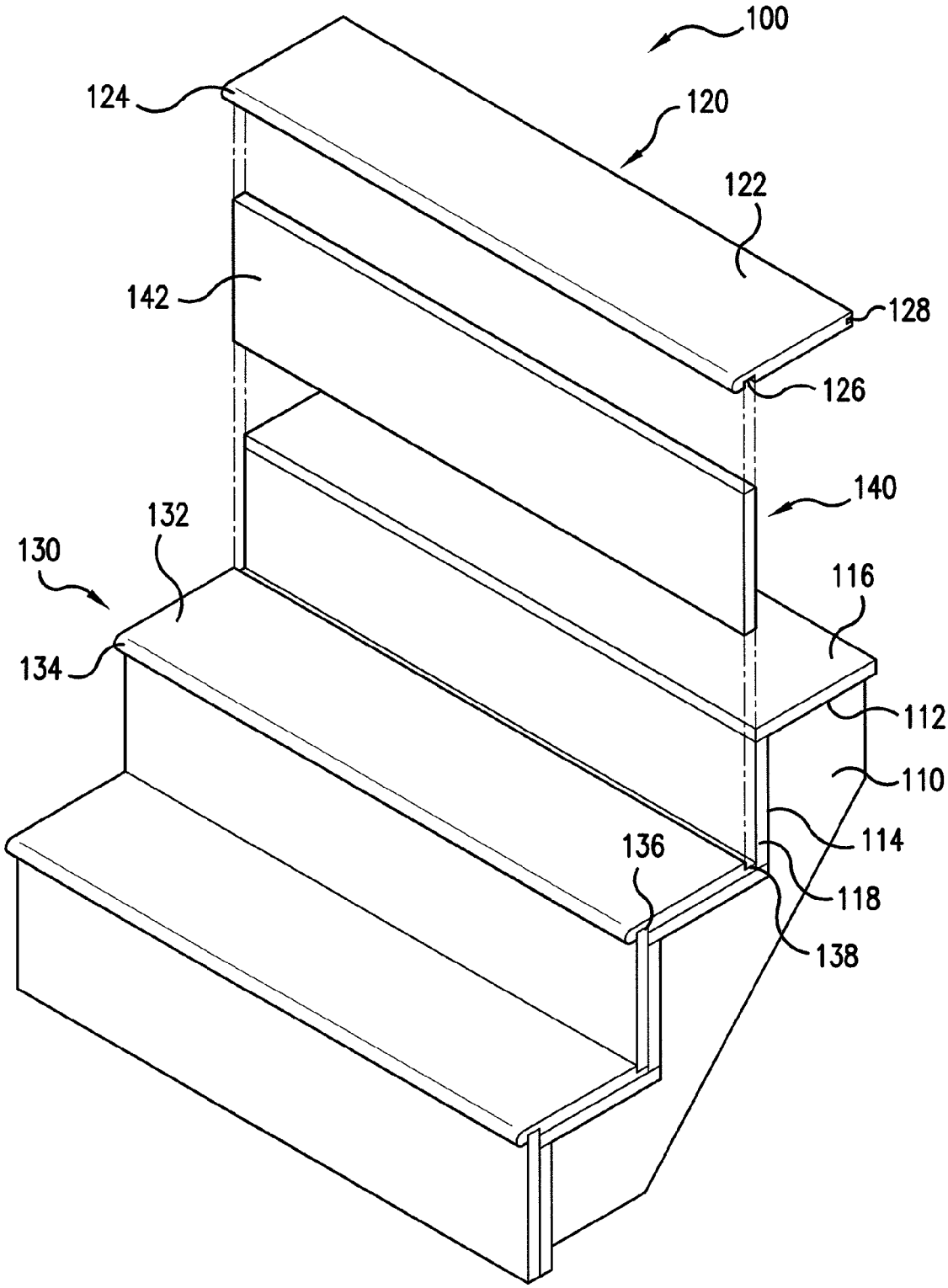
FIG. 1 is a partially exploded perspective view of the stair system according to a first exemplary embodiment of the present invention.

Referring to FIG. 1, the stair system 100 according to the first exemplary embodiment includes conventional stringers 110 (one shown), each stringer 110 provides a plurality of tread sides 112 and a plurality of riser sides 114 formed therein. A tread sub flooring 116 spans between corresponding tread sides 112 and a riser sub flooring 118 spans between corresponding riser side 114. The stringers 110, tread sub floorings 116, and riser sub floorings 118 are assembled using conventional techniques including fasteners and/or adhesives.

The stair system 100 includes at least two different treads depending on the location of the tread. As shown in FIG. 1, the uppermost tread or top tread 120 has a planar body portion 122 and a stair nose portion 124. A dado 126 is provided behind the stair nose portion 124 and extends along the length of the planar body portion 122. As shown in FIG. 1, the stair nose portion 124 may have a thickness equal to the planar body portion 122, although it is understood that the stair nose portion 124 may have a greater thickness than the planar body portion 122. In addition, the top tread 120 may have a dado 128 provided on a rear surface so as to be fitted with flooring at the top of stair system 100.

The stair system 100 includes one or more lower treads 130. Each lower tread 130 has a planar body portion 132 and a stair nose portion 134. A dado 136 is provided behind the stair nose portion 134 and extends along the length of the planar body portion 132. A rabbet 138 is provided at the edge opposite the stair nose portion 134 and extends along the length of the planar body portion 132. Preferably, the width of the rabbet 138 corresponds to the width of either dado 126, 136 depending on the type of tread, either the upper or lower tread 120, 130, arranged above it. As shown in FIG. 1, the stair nose portion 134 may have a greater thickness than the planar body portion 132, although it is understood that the stair nose portion 134 may have the same thickness as the planar body portion 132. Preferably, the stair nose portion 134 of the lower tread 130 has the same thickness of the stair nose portion 124 of the upper tread 120.

In addition to the two types of treads discussed above, the stair system 100 includes at least two risers 140. Each riser 140 has a substantially planar body 142 and is configured to cooperate with one or more of the treads to form the stair system 100.

The treads 120, 130 and risers 140 can be made out of natural plank wood, such as oak plank. However, the treads 120, 130, and risers 140 can be made out of composites or other preformed materials. In addition, the treads 120, 130, and risers 140 can be provided in many conventional plank widths and thickness, such as, three-quarter inch or one inch thick, as well as custom sizes. Preferably, the treads 120, 130 are sized such that the planar body portion is sufficiently sized to cover the tread sub flooring and that the rabbets and dados correspond to the thickness of the risers. In addition, it is desirable that the depth of the dados and rabbets are selected such that the risers are free to expand within the corresponding dado and/or rabbet without applying a large expansion force to the corresponding treads.

Next, an exemplary method of assembling the stair system 100 will be described. After the stringers 110, tread sub floorings 116, and riser sub floorings 118 are assembled using conventional techniques including fasteners and/or adhesives, the rest of the stair system is attached. Generally, this process begins at the bottom of the stair system 100 and progresses up the stair system, although it is understood that a top-down approach may also be used.

First, one of the plurality of risers 140 is affixed to the surface of the riser sub flooring 118 using adhesive. Because this riser 140 is located at the bottom of the stair system 100, it is preferably to only use an adhesive. However, it is understood that fasteners can be used and that if the fasteners are counter-sunk, then the holes may be filled in to hide their location. Alternatively, depending on the flooring that the stair system 100 rests on, the flooring and/or the stair nose portion 134 may hide fasteners.

As shown in FIG. 1, the riser 140 extends above the corresponding tread sub flooring 116 such that the lower tread 130 can be fitted over the riser 140 and that the dado 136 receives the riser 140 therein. The lower tread 130 can be affixed to the tread sub flooring 116 using fasteners and/or adhesives. Preferably, the planar body portion 132 is affixed with adhesive while the fasters (not shown) extend through the rabbet 138 into the tread sub flooring 116. In this manner, the lower tread 130 can be reliably mounted to the tread sub flooring 116, while allowing the fasteners to be hidden from view by the riser 140 inserted at the back of the lower tread 130.

Specifically, the next riser 140 is attached to riser sub flooring 118 adjacent the rabbet 138. The riser 140 can be attached to the rabbet 138 and/or the riser sub flooring 118 using adhesive. As noted previously, the riser 140 may also be attached using fasteners that are counter sunk and filled in and/or the fasteners may be hidden behind the stair nose portion 134. This process is repeated with the remaining lower treads 130 until the top of the stair system 100 is reached.

As shown in FIG. 1, the upper most riser 140 extends above the corresponding tread sub flooring 116 such that the upper tread 120 can be fitted over the riser 140 and that the dado 126 receives the riser 140 therein. The upper tread 120 can be affixed to the tread sub flooring 116 using fasteners and/or adhesives. Because no rabbet is provided in the upper tread 120, a continuous planar finish is achieved.

Depending on the materials selected, the above-described stair system 100 can be provided as a free standing stair system (i.e., no walls provided at either side of the stair system), supported by one wall, or supported by wall on both sides of the stair system. Specifically, depending on the finishing of the wood, the stair system can have an aesthetic appearance without further finishing.

Figure 2:
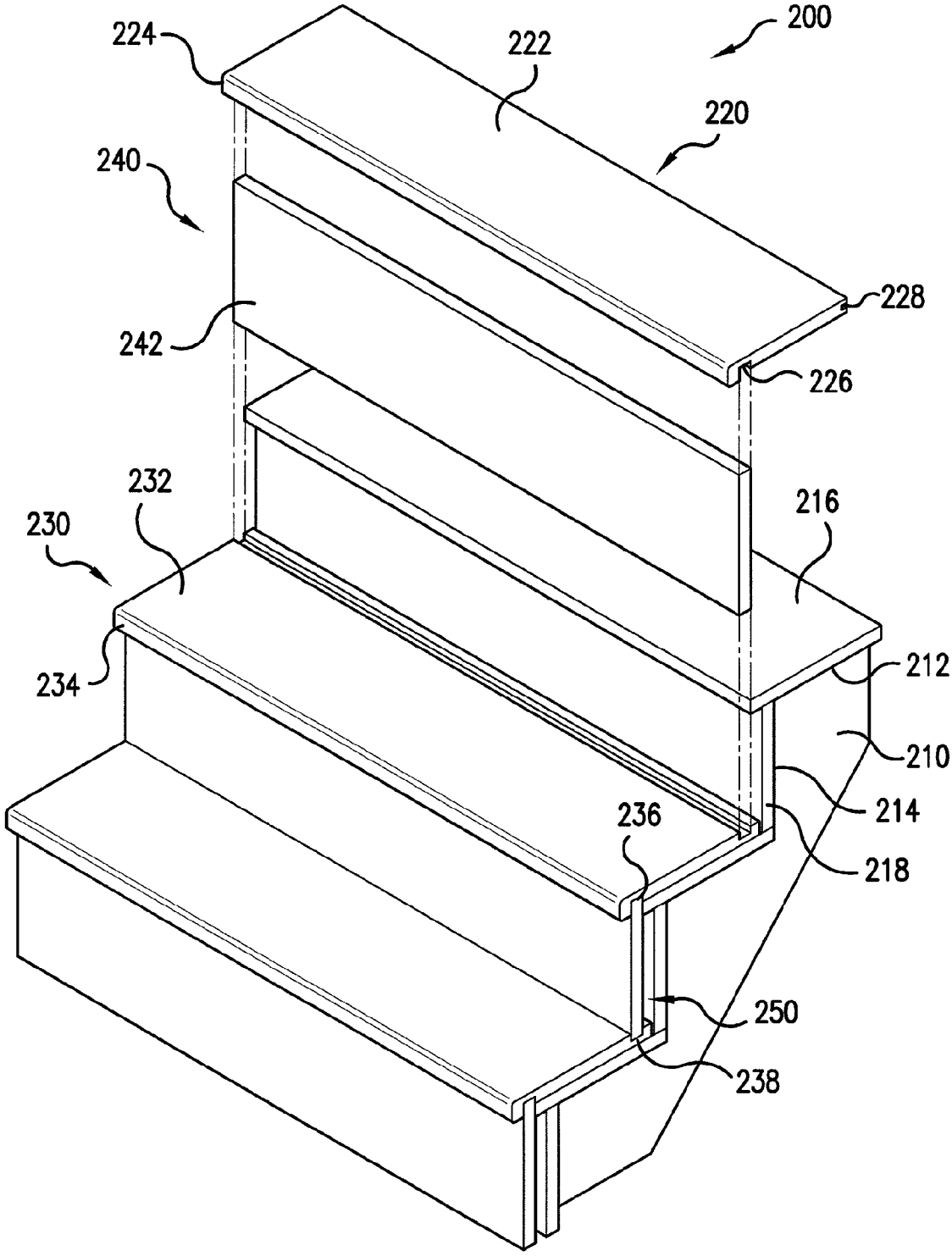
FIG. 2 is a partially exploded perspective view of the stair system according to a second exemplary embodiment of the present invention.

Because there are times when it is desirable to remove and replace existing tread and/or carpeting, the stair system 100 can be readily adapted to such a process. For example, as shown in FIG. 2, a stair system 200 similar to stair system 100 can be provided. In this arrangement, existing stringers 210 (one shown) may be used. Each stringer 210 includes a plurality of tread sides 212 and a plurality of riser sides 214 formed therein. Existing tread sub flooring 216 spans between corresponding tread sides 212 and existing riser sub flooring 218 spans between corresponding riser side 214. In this exemplary embodiment, the tread sub flooring 216 extends beyond the riser sub flooring a predetermined distance to allow carpeting to wrap around the edge of the tread sub flooring 216 and to be affixed to a lower surface of the tread sub flooring 216. The stringers 210, tread sub floorings 216, and riser sub floorings 218 were previously assembled using conventional techniques including fasteners and/or adhesives.

As described above for the stair system 100, the stair system 200 includes at least two different treads depending on the location of the tread. As shown in FIG. 2, the uppermost tread or top tread 220 has a planar body portion 222 and a stair nose portion 224. A dado 226 is provided behind the stair nose portion 224 and extends along the length of the planar body portion 222. As shown in FIG. 2, the stair nose portion 224 may have a greater thickness than the planar body portion 222, although it is understood that the stair nose portion 224 may have the same thickness as the planar body portion 222. In addition, the top tread 220 may have a dado 228 provided on a rear surface so as to be fitted with flooring at the top of stair system 100.

The stair system 200 includes one or more lower treads 230. Each lower tread 230 has a planar body portion 232 and a stair nose portion 234. A dado 236 is provided behind the stair nose portion 234 and extends along the length of the planar body portion 232. A second dado 238 is provided near the edge opposite the stair nose portion 234 and extends along the length of the planar body portion 232. Preferably, the width of the second dado 238 corresponds to the width of either dado 226, 236 depending on the type of tread, either the upper or lower tread 220, 230, arranged above it. As shown in FIG. 2, the stair nose portion 234 may have a greater thickness than the planar body portion 232, although it is understood that the stair nose portion 234 may have the same thickness as the planar body portion 232. Preferably, the stair nose portion 234 of the lower tread 230 has the same thickness of the stair nose portion 224 of the upper tread 220.

In addition to the two types of treads discussed above, the stair system 200 includes at least two risers 240. Each riser 240 has a substantially planar body 242 and is configured to cooperate with one or more of the treads to form the stair system 200.

The treads 220, 230 and risers 240 can be made out of natural plank wood, such as oak plank. However, the treads 220, 230, and risers 240 can be made out of composites or other preformed materials. In addition, the treads 220, 230, and risers 240 can be provided in many conventional plank widths as well as custom sizes. Preferably, the treads 220, 230 are sized such that the planar body portion is sufficiently sized to cover the tread sub flooring and that the dados correspond to the thickness of the risers. In addition, it is desirable that the depth of each dado is selected such that the risers are free to expand within the corresponding dado without applying a large expansion force to the corresponding treads.

Finally, as shown in FIG. 2, a gap 250 is formed by the arrangement of the riser 240, tread sub flooring 216, and riser sub-flooring 218. If desired, a pad or other sound dampening material may be placed in the gap to absorb sound during use of the stair system 200.

Next, an exemplary method of assembling the stair system 200 will be described. After removing any old tread and/or carpeting from the tread sub floorings 216 and riser sub floorings 218, the rest of the stair system is attached. Generally, this process begins at the bottom of the stair system 200 and progresses up the stair system, although it is understood that a top-down approach may also be used.

First, because the riser sub flooring 218 is recessed from the end of the tread sub flooring 216, one of the plurality of risers 240 is affixed to the end of the tread sub flooring 216 using adhesive and/or fasteners. Because this riser 240 is located at the bottom of the stair system 200, it is preferably to only use an adhesive. However, it is understood that fasteners can be used and that fasteners can be hidden by the stair nose portion 234 of the adjacent lower tread 230. Alternatively, depending on the flooring that the stair system 200 rests on, that flooring may also hide the fasteners.

As shown in FIG. 2, the riser 240 extends above the corresponding tread sub flooring 216 such that the lower tread 230 can be fitted over the riser 240 and that the dado 236 receives the riser 240 therein. The lower tread 230 can be affixed to the tread sub flooring 216 using fasteners and/or adhesives. Preferably, the planar body portion 232 is affixed with adhesive while the fasters (not shown) extend through the second dado 238 into the tread sub flooring 216. In this manner, the lower tread 230 can be reliably mounted to the tread sub flooring 216, while allowing the fasteners to be hidden from view by the riser 240 inserted at the back of the lower tread 230.

Specifically, the next riser 240 is attached to the tread sub flooring 216 located above the second dado 238. The riser 240 can be attached to the second dado 238 and/or the tread sub flooring 218 using adhesive. As noted previously, the riser 240 may also be attached using fasteners. This process is repeated with the remaining lower treads 230 until the top of the stair system 200 is reached.

As shown in FIG. 2, the upper most riser 240 extends above the corresponding tread sub flooring 216 such that the upper tread 220 can be fitted over the riser 240 and that the dado 226 receives the riser 240 therein. The upper tread 220 can be affixed to the tread sub flooring 216 using fasteners and/or adhesives. Because there is no second dado provided in the upper tread 220, a planar finish is achieved.

As mentioned previously, the spaces 250 between the risers 240 and the riser sub flooring 218 may be filled with pads or other sound absorbing material. Depending on the accessibility of the spaces, the pads may be inserted before securing the corresponding riser 240 to the tread sub flooring 218 or after the riser 240 is secured to the tread sub flooring (e.g., one edge of the stair system 200 is temporarily exposed.)

Because the second exemplary stair system 200 will most likely be used to replace existing stairs with old tread and/or carpeting, the stair system 200 will probably be supported by walls on both sides of the stair system to hide the space 250 between the riser 240 and the riser sub flooring 218. Further, because the above stair systems 100 and 200 are very efficient to assemble and minimize the amount of material used, they provide very simple designs. As such, with small modifications to the systems, more ornate designs can be provided.

Figure 3:
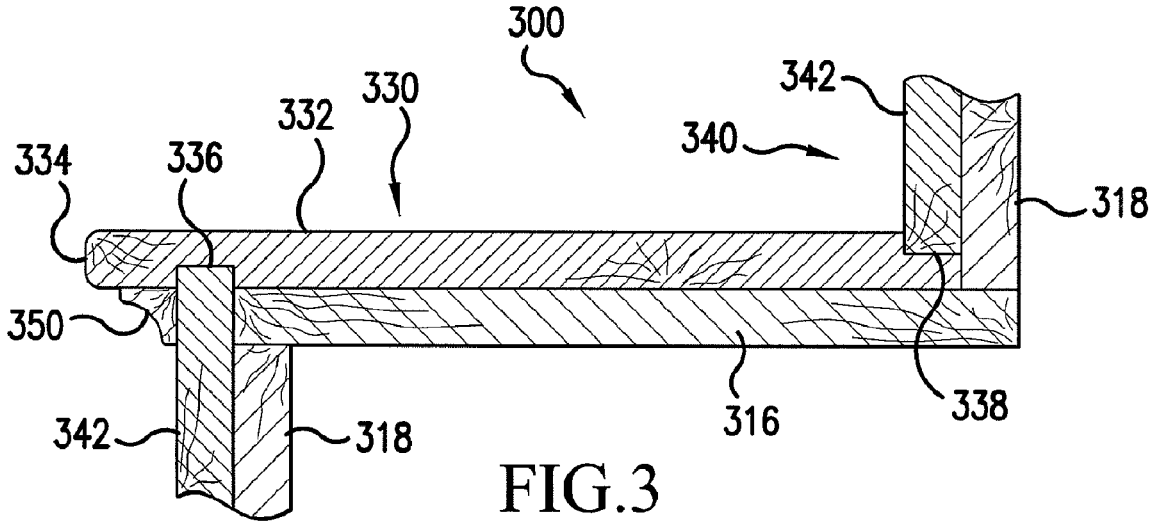
FIG. 3 is a schematic cross-sectional view of a stair system according to a third exemplary embodiment of the present invention.

As shown in FIG. 3, a stair system 300 similar to stair system 100 includes one or more treads 330 and at least two risers 340. Each tread 330 has a planar body portion 332 and a stair nose portion 334. A dado 336 is provided behind the stair nose portion 334 and extends along the length of the planar body portion 332. A rabbet 338 is provided at the edge opposite the stair nose portion 334 and extends along the length of the planar body portion 332. Preferably, the width of the rabbet 338 corresponds to the width of dado 336. As shown in FIG. 3, the stair nose portion 334 may have the same thickness as the planar body portion 332, although it is understood that the stair nose portion 334 may have a greater thickness than the planar body portion 332. The tread 330 is affixed to the tread sub flooring 316 in a similar manner as described above with regards to stair system 100.

Each riser 340 has a substantially planar body 342 and is configured to cooperate with one or more treads 330 to form the stair system 300. Each riser 340 is affixed to the riser sub flooring 318 in a similar manner as described above with regard to stair system 100. Further, one or more molding pieces 350 may be provided to further conceal the connection of the riser 340 to the tread 330. In particular, the molding piece 350 may be affixed to one of the risers 340 or the lower surface of the tread 330 so that the free-floating nature of the stair system 300 is maintained.

The molding piece 350 can also serve to reinforce the tread 330 by distributing weight applied to the tread to a large surface area on the riser 340 disposed beneath the tread 330. In addition, the molding piece 350 can be affixed to both the riser 340 and the tread 330, but the free floating nature of the stair system may be hindered.

While the stair system 300 has been described as being similar to stair system 100, it is understood that molding pieces 350 can be used in a stair system similar to stair system 200. In either arrangement, the molding pieces can be affixed to at least one of the risers and the lower surfaces of the treads after the main assembly of the corresponding stair system as described above.

Figure 4:
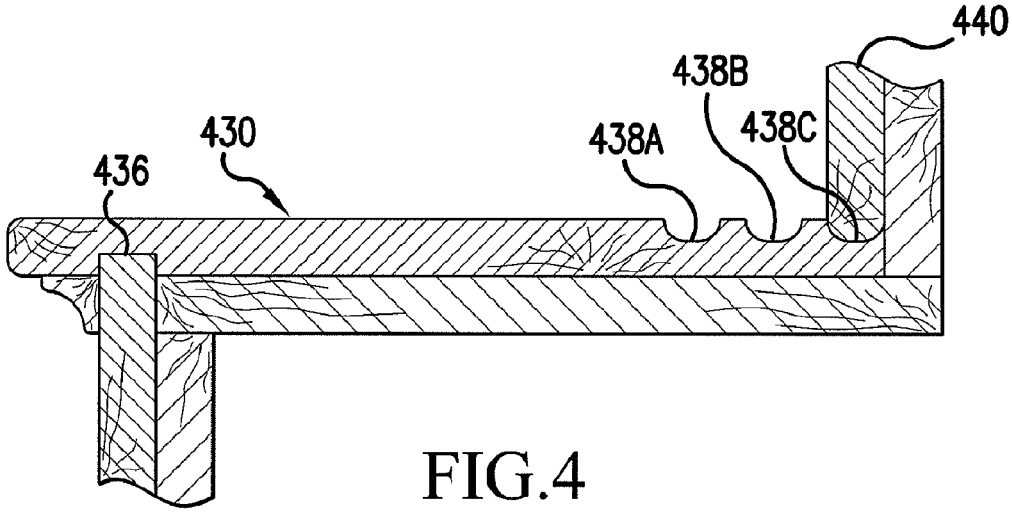
FIG. 4 is a schematic cross-sectional view of a stair system according to a fourth exemplary embodiment of the present invention.

In addition to providing molding pieces 350, the structure of the treads 330 and risers 340 can be modified to provide various effects. With reference to FIG. 3, the tread 330 includes a rectangular shaped dado 336 and a single planar cut rabbet 338. However, the present invention is not so limited. For example, as shown in FIG. 4, the tread 430 may include a plurality of grooves 438A, 438B, 438C formed in the upper surface of the tread 430. Each of the grooves 438A, 438B, and 438C function similar to a rabbet or dado formed in the upper surface of the tread 330 and are capable of receiving a riser 440 therein. The ends of the riser 440 can be shaped to correspond to the shape of dado 436 of the adjacent tread 430 and the shape of an individual groove, respectively.

By providing the plurality of grooves 438A, 438B, 438C, the placement of the riser 440 can be controlled. As a result, a single tread 430 can be used for either stair system 100 or stair system 300. In other words, when the riser 440 is placed in groove 438C, the stair system where the riser is placed against the riser sub floor is formed. When the riser 440 is placed in groove 438A or 438B, the stair system where the riser is spaced from the riser sub floor is formed. In this manner, a single style of tread 430 can be used in many different stair systems. In addition, depending on the number of grooves provided, the remaining grooves can provide both function and style. For example, when the riser 440 is placed in groove 438C, the remaining grooves 438A and 438B can increase traction to avoid slipping on the tread 430.

Figure 5:
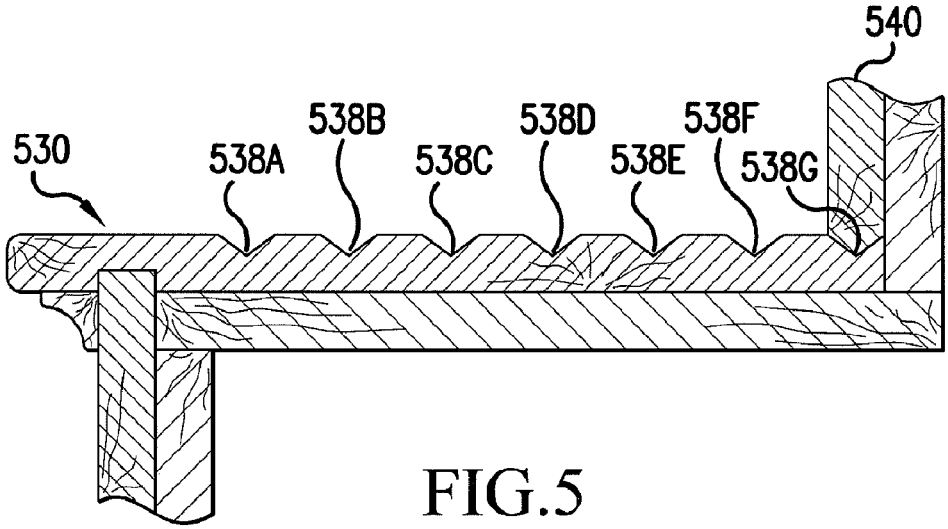
FIG. 5 is a schematic cross-sectional view of a stair system according to a fifth exemplary embodiment of the present invention.

Depending on the desired design and function, the number and shapes of the plurality of grooves can be modified. For example, as shown in FIG. 5, the tread 530 includes a plurality of grooves 538A-538G. In this embodiment, each of the grooves 538A-538G are formed to have a triangular cross-section and are evenly spaced apart. It is understood that the spacing of the grooves could be varied so that there are either a greater number of grooves towards the stair nose 534 to provide added traction or a greater number of grooves towards the rear of the tread 530 to allow for finer placement of the riser 540. In addition, the shapes of the individual grooves can be varied and many different patterns can be provided.

Figure 6A:
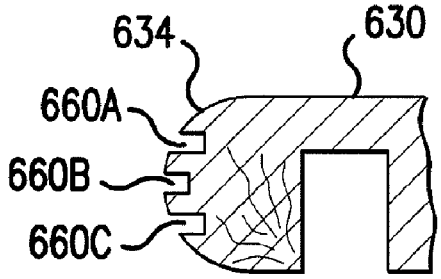
FIGS. 6A to 6F show modifications of a stair nose for a tread of a stair system similar to the first exemplary embodiment of FIG. 1.
Figure 6B:
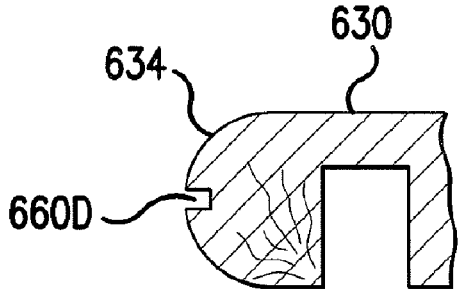
Figure 6C:
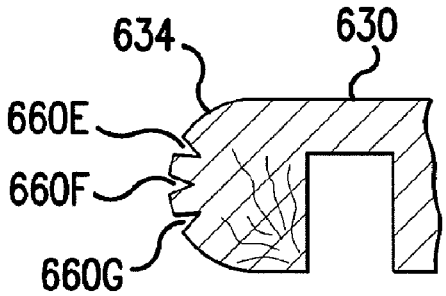
Figure 6D:
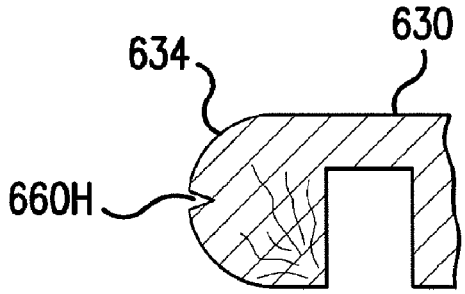
Figure 6E:
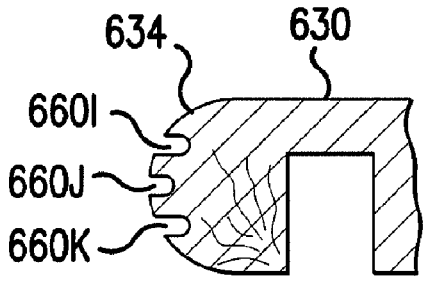
Figure 6F:
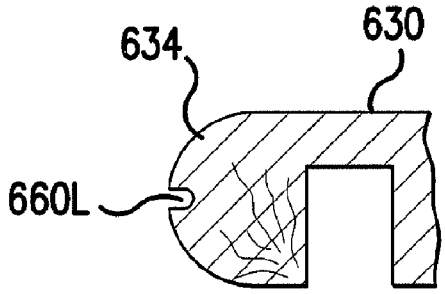
Figure 7A:
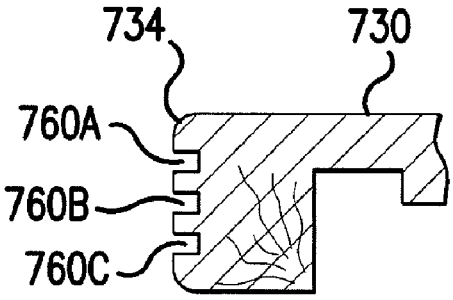
FIGS. 7A to 7F show modifications of a stair nose for a tread of a stair system similar to the second exemplary embodiment of FIG. 2.
Figure 7B:
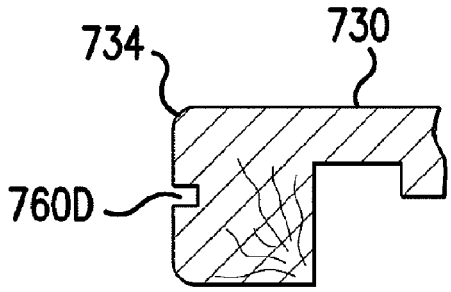
Figure 7C:
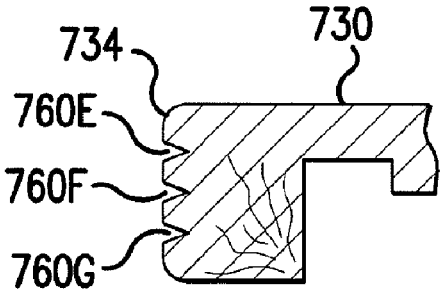
Figure 7D:
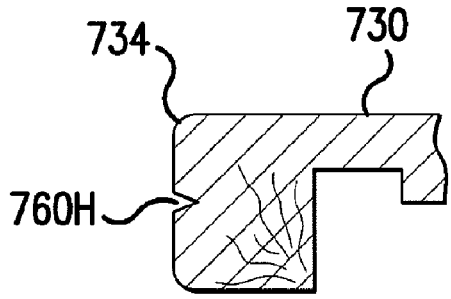
Figure 7E:
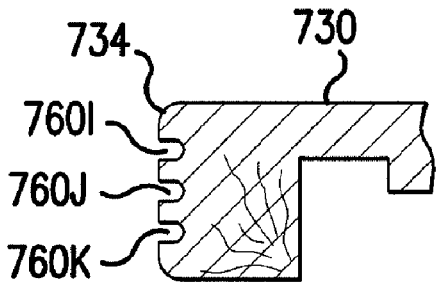
Figure 7F:
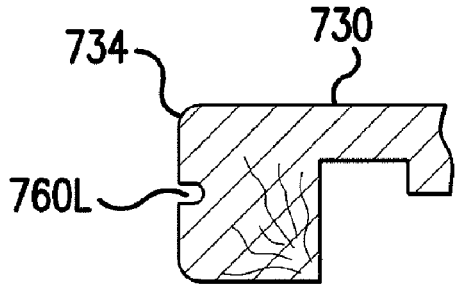

In addition to providing a plurality of grooves formed on the upper surface of the tread as shown in the previous embodiments, the stair nose may be provided with one or more grooves to provide a stylized appearance for the stair system. For example as shown in FIGS. 6A and 6B, stair nose 634 of tread 630, which is similar to the tread 130 of the first exemplary stair system 100, may have multiple grooves 660A, 660B, and 660C (FIG. 6A) or a singe groove 660D (FIG. 6B). As show in FIGS. 6A and 6B, the grooves 660A, 660B, 660C, and 660D may have a rectangular cut-out, but the present invention is not so limited. For example, the stair nose may have multiple grooves 660E, 660F, 660G (FIG. 6C) or a single groove 660H (FIG. 6D) having the shape of a triangular cut-out, or the grooves 660I, 660J, 660K, 660L may be have rounded cut-outs (FIGS. 6E and 6F). The number and spacing of the grooves in the stair nose may be varied depending on the size of the grooves and the size of the stair nose. Preferably, if the tread 630 includes grooves in the upper surface as described above, the shape of the grooves in the stair nose corresponds to the shapes of the of the grooves in the upper surface.

The grooves in the stair nose may also be provided on a tread 730 that is similar in shape to the tread 230 of the second exemplary stair system 200. For example, as shown in FIGS. 7A to 7E, the shape and number tread are similar to those shown in FIGS. 6A to 6E.

Figure 8:
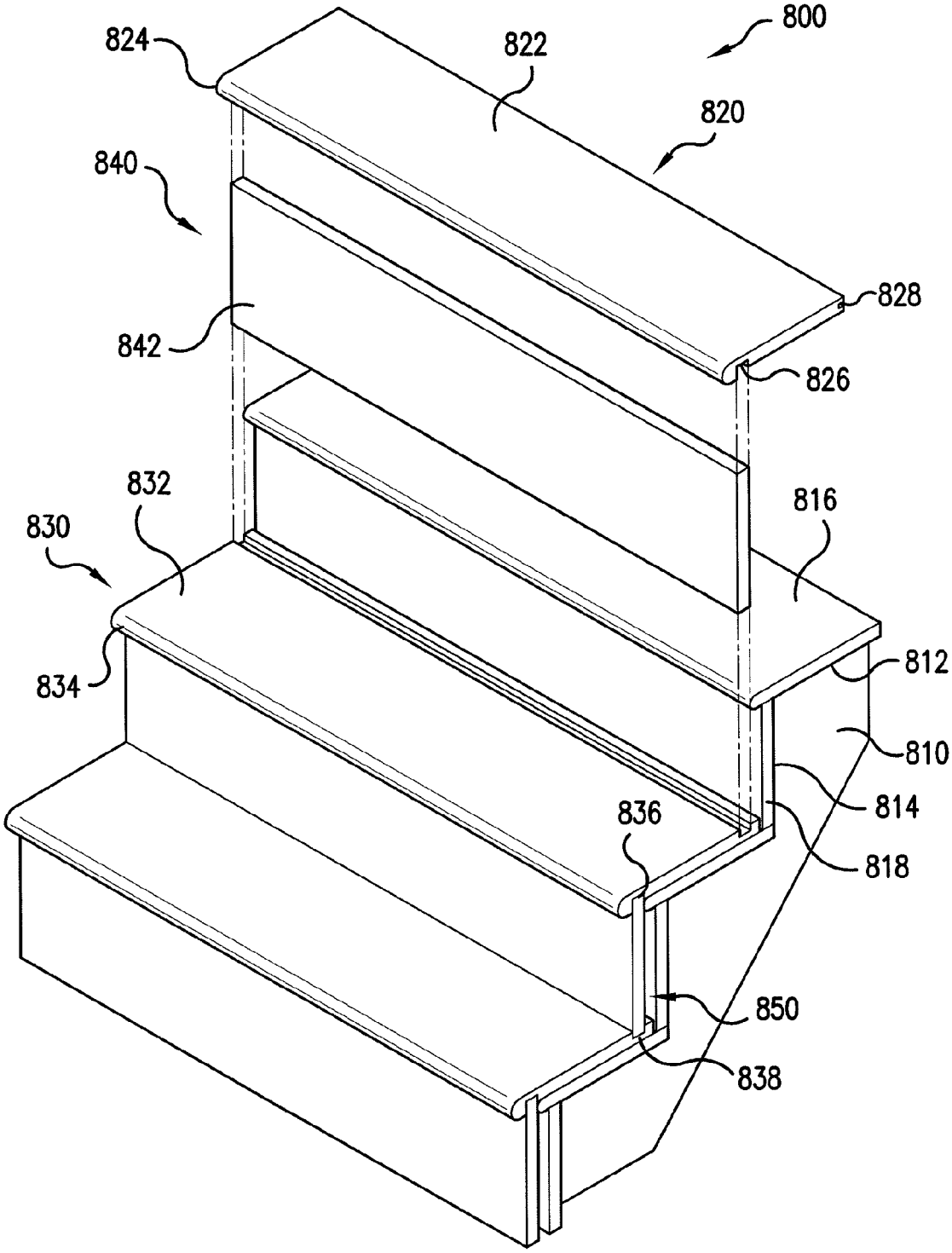
FIG. 8 is a partially exploded perspective view of the stair system according to a sixth exemplary embodiment of the present invention.
Figure 9:
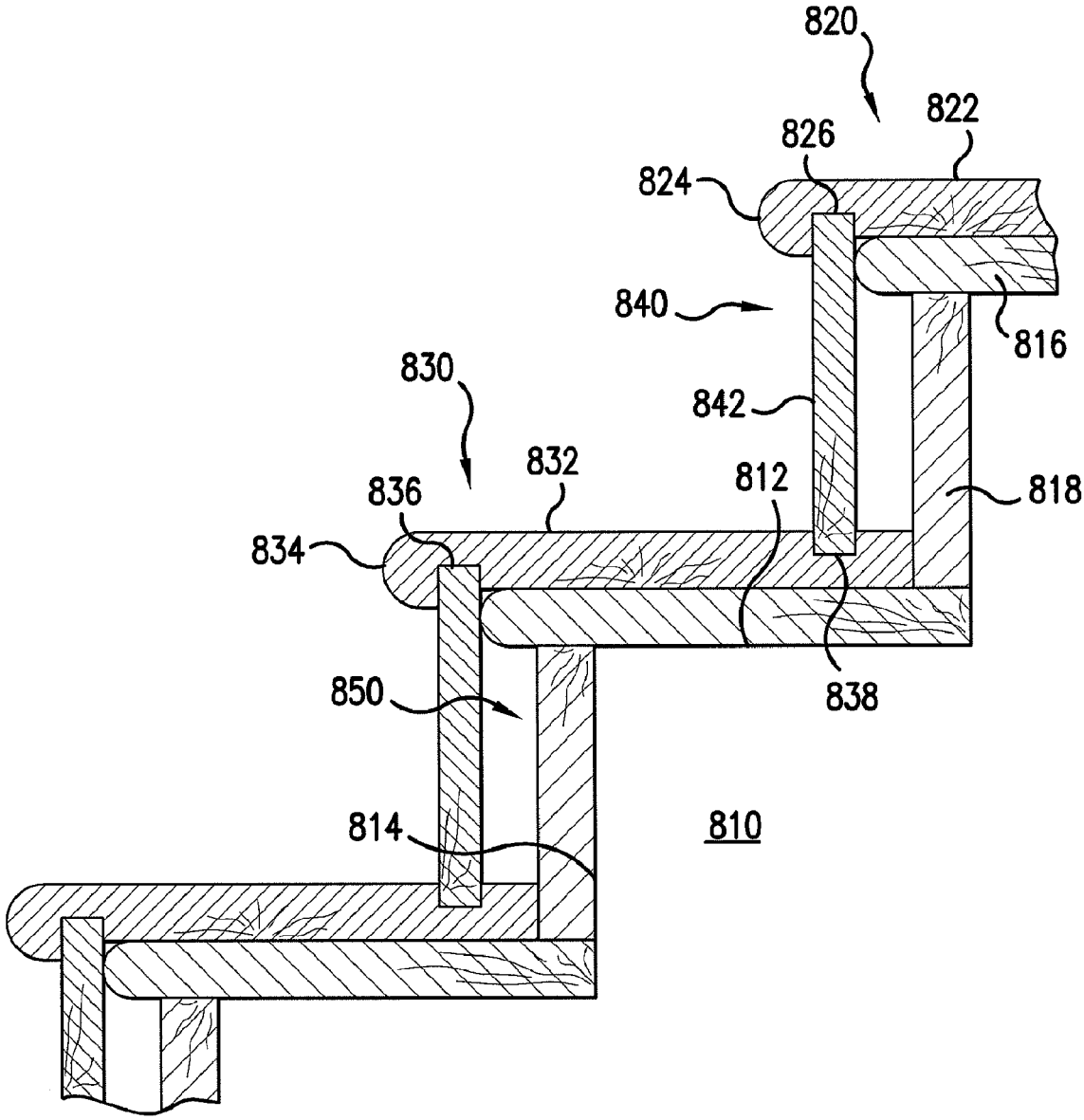
FIG. 9 is a partial schematic cross-sectional view of the stair system of FIG. 8.

A sixth exemplary embodiment of a stair system is shown in FIGS. 8 and 9. As described above for the stair system 200, the stair system 800 includes at least two different treads depending on the location of the tread. As shown in FIG. 8, the uppermost tread or top tread 820 has a planar body portion 822 and a stair nose portion 824. A dado 826 is provided behind the stair nose portion 824 and extends along the length of the planar body portion 822. As shown in FIG. 8, the stair nose portion 824 may have a greater thickness than the planar body portion 822, although it is understood that the stair nose portion 824 may have the same thickness as the planar body portion 822. In addition, the top tread 820 may have a dado 828 provided on a rear surface so as to be fitted with flooring at the top of stair system 100.

The stair system 800 includes one or more lower treads 830. Each lower tread 830 has a planar body portion 832 and a stair nose portion 834. A dado 836 is provided behind the stair nose portion 834 and extends along the length of the planar body portion 832. A second dado 838 is provided near the edge opposite the stair nose portion 834 and extends along the length of the planar body portion 832. Preferably, the width of the second dado 838 corresponds to the width of either dado 826, 836 depending on the type of tread, either the upper or lower tread 820, 830, arranged above it. As shown in FIG. 8, the stair nose portion 834 may have a greater thickness than the planar body portion 832, although it is understood that the stair nose portion 834 may have the same thickness as the planar body portion 832. Preferably, the stair nose portion 834 of the lower tread 830 has the same thickness of the stair nose portion 824 of the upper tread 820.

In addition to the two types of treads discussed above, the stair system 800 includes at least two risers 840. Each riser 840 has a substantially planar body 842 and is configured to cooperate with one or more of the treads to form the stair system 800. As shown in FIGS. 8 and 9, each riser 840 can be substantially thinner than the planar body portions 822 and 832 of treads 820 and 830.

The treads 820, 830 and risers 840 can be made out of natural plank wood, such as oak plank. However, the treads 820, 830, and risers 840 can be made out of composites or other preformed materials. In addition, the treads 820, 830, and risers 840 can be provided in many conventional plank widths as well as custom sizes. Preferably, the treads 820, 830 are sized such that the planar body portion is sufficiently sized to cover the tread sub flooring and that the dados correspond to the thickness of the risers. In addition, it is desirable that the depth of each dado is selected such that the risers are free to expand within the corresponding dado without applying a large expansion force to the corresponding treads.

Finally, as shown in FIG. 8, a gap 850 is formed by the arrangement of the riser 840, tread sub flooring 816, and riser sub-flooring 818. If desired, a pad or other sound dampening material may be placed in the gap to absorb sound during use of the stair system 800.

The previously described stair systems allow for quick and easily assembly by minimizing the number of components provided for the stair system. In addition, the treads and risers may be prefabricated such that stair systems can be modular designs. Furthermore, the above stair systems allow old tread and/or carpets to be replaced without removing the entire stair system.

The invention thus being described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. A stair system comprising:

a tread having a substantially planar body portion, a stair nose portion located at one side of the planar body portion, a dado located behind the stair nose portion, and a first plurality of grooves located at a side opposite the dado;

a first riser having a substantially planar body portion, the first riser being received in one of the first plurality of grooves; and a second riser having a substantially planar body portion, the second riser being received in the dado of the tread, wherein all of the first plurality of grooves have substantially the same cut-out, and wherein each groove of the first plurality of grooves is capable of receiving the first riser.

2. The stair system according to claim 1, wherein the first plurality of grooves are spaced closer towards an end opposite the stair nose portion.

3. The stair system according to claim 1, wherein the first plurality of grooves are substantially evenly spaced between the stair nose portion and an end opposite the stair nose portion.

4. The stair system according to claim 1, wherein each of the first plurality of grooves is selected from a rectangular cut-out, a substantially circular cut-out, and a triangular cut-out.

5. The stair system according to claim 1, further comprising a molding located beneath the tread and adjacent the dado of the tread.

6. The stair system according to claim 5, wherein the molding is affixed to at least one of the tread and the second riser.

7. The stair system according to claim 1, wherein the stair nose of the tread includes a second groove formed therein.

8. The stair system according to claim 1, wherein the stair nose of the tread includes a plurality of second grooves formed therein.

9. The stair system according to claim 8, wherein at least one of the second plurality of grooves is selected from a rectangular cut-out, a substantially circular cut-out, and a triangular cut-out.

10. The stair system according to claim 8, wherein each of the second plurality of grooves is selected from a rectangular cut-out, a substantially circular cut-out, and a triangular cut-out.

11. The stair system according to claim 10, wherein all of the second plurality of grooves have substantially the same cut-out.

12. A stair system comprising:

an upper tread having a substantially planar body portion, a stair nose portion located at one side of the planar body portion, and a dado located behind the stair nose portion;

at least one lower tread, the lower tread having a substantially planar body portion, a stair nose portion located at one side of the planar body portion, a dado located behind the stair nose portion, and a first plurality of grooves located at a side opposite the dado; and at least two risers, each riser having a substantially planar body portion, one of the at least two risers being receivable between the dado of the upper tread and one of the grooves of the first plurality of grooves of the lower tread, and the other of the at least two risers being receivable in the dado of the lower tread, wherein all of the first plurality of grooves have substantially the same cut-out, and wherein each groove of the first plurality of grooves is capable of receiving the first riser.

13. The stair system according to claim 12, wherein the first plurality of grooves of the at least one lower tread is formed in an upper surface of the planar body portion.

14. The stair system according to claim 12, wherein the at least one lower tread includes a plurality of lower treads, each of the lower treads having a substantially planar body portion, a stair nose portion located at one side of the planar body portion, a dado located behind the stair nose portion, and a groove located at a side opposite the stair nose portion; and wherein the at least two risers includes a plurality of risers such that the number of risers corresponds to the number of lower treads plus the upper riser.

15. The stair system according to claim 12, wherein the stair nose portions of the upper tread has a thickness substantially equal to the thickness of the planar body portion of the upper tread and the stair nose portion of the at least one lower tread has a thickness substantially equal to the thickness of the planar body portion of the at least one lower tread.

16. The stair system according to claim 12, wherein the stair nose portions of the upper tread has a thickness greater than the thickness of the planar body portion of the upper tread and the stair nose portion of the at least one lower tread has a thickness greater than the thickness of the planar body portion of the at least one lower tread.

17. The stair system according to claim 1, further comprising:

at least two stringers, each stringer having a plurality of tread sides and a plurality of riser sides;

a plurality of tread sub-floorings corresponding to the plurality of tread sides, each of the plurality of tread sub-floorings spanning between the at least two stringers and affixed to corresponding tread sides;

a plurality of riser sub-floorings corresponding to the plurality of riser sides, each of the plurality of riser sub-floorings spanning between the at least two stringers and affixed to corresponding riser sides.

18. The stair system according to claim 17, wherein the upper tread is affixed to one of the plurality of tread sub-floorings, the at least one lower tread is affixed to another of the plurality of tread sub-floorings, and each of the at least two risers are affixed to different riser sub-floorings.

19. The stair system according to claim 17, wherein an end of each of the tread sub-flooring extends beyond the lower adjacent riser sub-flooring such that the riser sub-flooring is recessed behind the end of the tread sub-flooring.

20. The stair system according to claim 19, wherein the upper tread is affixed to one of the plurality of tread sub-floorings and the at least one lower tread is affixed to another of the plurality of tread sub-floorings.

21. The stair system according to claim 20, wherein each of the plurality of risers are affixed to the corresponding dado.

22. The stair system according to claim 21, wherein each of the plurality of risers are affixed to the end of the upper adjacent tread sub-flooring.

* * * * *